United States Patent [19]

Owen

[11] 4,110,998

[45] Sep. 5, 1978

[54] APPARATUS FOR DETECTING AND REMOVING CONTAMINANTS FROM A REFRIGERATION SYSTEM

[76] Inventor: Charles Owen, 2120 Cannon Way, Marietta, Ga. 30064

[21] Appl. No.: 801,043

[22] Filed: May 27, 1977

[51] Int. Cl.[2] ..... F25B 45/00

[52] U.S. Cl. ..... 62/125; 62/292

[58] Field of Search ..... 62/77, 292, 149, 174, 62/85, 125

[56] References Cited

U.S. PATENT DOCUMENTS

| | | | |
|---|---|---|---|
| 2,341,429 | 2/1944 | Elsey | 62/85 X |
| 3,145,544 | 8/1964 | Weller | 62/85 X |
| 3,232,070 | 2/1966 | Sparano | 62/292 X |

*Primary Examiner*—William E. Wayner

*Attorney, Agent, or Firm*—Newton, Hopkins & Ormsby

[57] ABSTRACT

A device for detecting and removing contaminants from charged refrigeration systems comprising conduit means temporarily communicating the high pressure liquid line of the system with the lower pressure suction line, the conduit means having means for visually determining the moisture content within the refrigerant charge, filter means for removal of the contaminant and a pressure differential means for allowing the refrigerant to return into the system in low pressure gas form. Means are also provided for selectively introducing into the conduit means a sufficient amount of new charge to replace the contaminated charge which is removed from the system by the filter means.

8 Claims, 1 Drawing Figure

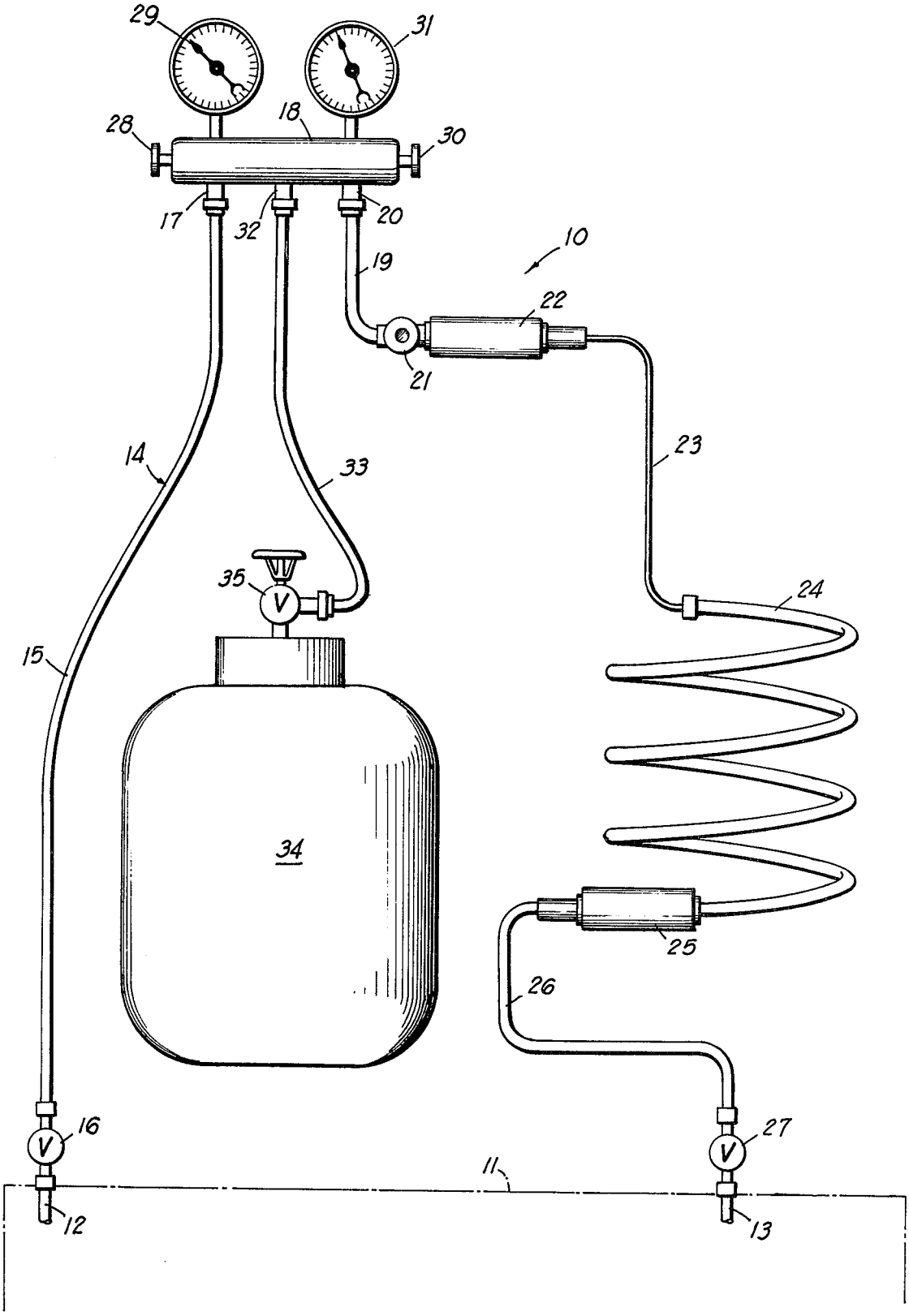
29
31
28
18
30
17
32
20
10
19
22
21
14
33
23
35
24
15
34
25
26
16
27
11
12
13

APPARATUS FOR DETECTING AND REMOVING CONTAMINANTS FROM A REFRIGERATION SYSTEM

BACKGROUND OF THE INVENTION

1. Field of the Invention

This invention relates to refrigeration systems and, more particularly, to a device for removing contaminants from a charged refrigeration system and introducing additional refrigerant into the closed system.

2. Description of the Prior Art

Normally in charged refrigerant systems, such as air conditioning equipment, if moisture or other contaminants are found in the refrigerant (such as freon) in the system, the entire amount of refrigerant is discharged into the air and a new supply of charging material is introduced into the system. This is a costly and wasteful method of ridding the refrigerant system of contaminants.

Kelley, U.S. Pat. No. 2,214,698, issued Sept. 10, 1940 shows an apparatus for charging a system with refrigerant and lubricants. Sporano, U.S. Pat. No. 3,232,070, issued Feb. 1, 1966 discloses an apparatus for withdrawing and storing refrigerant from a disabled unit. Elsey, U.S. Pat. No. 2,341,439, issued Feb. 8, 1944 discloses a method of reclaiming the refrigerant of a refrigerating system. None of the prior art devices provide a means for repairing a closed, charged refrigerant system while it is continuing to operate in order to remove contaminants therefrom and to add new refrigerant thereto.

SUMMARY OF THE INVENTION

The disadvantages of the prior art are overcome by the present invention, which provides an apparatus for detecting and removing contaminants in a pre-charged refrigerant system and also provides means for selectively introducing into the system an amount of refrigerant equal to the contaminated refrigerant that has been removed therefrom. The invention is used in connection with standard refrigerant systems having a liquid or compressed refrigerant which carries the refrigerant from the compressor and a low pressure or suction line which carries vaporized refrigerant from the evaporator. The apparatus includes a conduit which attaches at one end to the liquid line and at the other end to the suction line. Some of the high pressure refrigerant liquid passes from the liquid line into the conduit.

A sight glass with a moisture indicator allows the operator to visually detect any contaminants in the refrigerant. The refrigerant then passes through a liquid line filter dryer where some of the contaminants are removed and then into a refrigerant metering device which provides a pressure differential between the high pressure side of the line and an evaporator coil within the conduit. The refrigerant, now at a lower pressure after it passes through the evaporator coil, passes through a suction line dryer and into the suction line of the system. The appartus is operated continually for a 24–48 hour period, during which time substantially all of the refrigerant will have passed through the apparatus and various contaminants will have been removed therefrom.

Also located in the conduit is a manifold which is connected to a source of new refrigerant. If a significant amount of contaminated refrigerant is removed from the system, a fresh supply of refrigerant may be selectively introduced into the system through the manifold.

It is, therefore, a primary object of the present invention to provide a means for detecting and removing refrigerant contaminants from pre-charged refrigerant systems without disrupting the operation of the systems.

Another object of the present invention is to provide a means for cleaning the charging material of an air cooled air conditioning or refrigeration system while the system continues to operate.

A further object of the present invention is to provide a means for selectively introducing fresh refrigerant into a pre-charged cooling system.

Another object of the present invention is to provide a portable apparatus which can be utilized by refrigeration repairmen to detect and remove moisture and other contaminants from pre-charged (factory charged) air cooled air conditioning and refrigeration systems.

A still further object of the present invention is to provide a device which will help to extend the life of the compressor of a refrigeration system.

Another object of the present invention is to provide a device which will eliminate the discharge into the atmosphere of a contaminated refrigerant.

BRIEF DESCRIPTION OF THE DRAWING

The Figure of the drawing is a schematic representation of the apparatus of the present invention.

DESCRIPTION OF THE PREFERRED EMBODIMENT

With reference to the Figure of the drawing, the numeral 10 represents the device of the present invention and 11 generally represents a standard, closed refrigerating apparatus of the type having a motor, compressor, evaporator, condenser, and various associated, valves and pipes. The cooling agent which flows through the refrigerating apparatus 11 is a liquid refrigerant, such as freon. Two of the pipes include a liquid or compressed refrigerant line 12 which carries the refrigerant at a high pressure from the motor-compressor unit of refrigerating apparatus 11 and a suction or low pressure line 13 which carries vaporized refrigerant from the evaporator portion of apparatus 11.

For a variety of reasons, the refrigerant of apparatus 11 may become contaminated with moisture acid and/or other contaminants, thus affecting the cooling efficiency of the refrigerant and the refrigerating apparatus 11. In order to rid the apparatus 11 of those contaminants while still allowing the apparatus to operate normally, the device 10 can be installed on the refrigerating apparatus 11 to remove the contaminants therefrom.

The device 10 comprises a liquid conduit 14 which temporarily communicates the liquid line 12 and the suction line 13. The conduit 14 is comprised of a liquid tube 15 which is in flow communication at one of its ends with the liquid line 12 through service valve 16 and at its other end with the intake port 17 of a manifold 18. A discharge tube 19 is connected to the outlet port 20 of manifold 18 and carries the refrigerant through a sight glass 21 which has a moisture indicator therein.

From the sight glass 21, the refrigerant passes into a liquid line filter/dryer 22 which may or may not have a removable filter core (not shown). From filter/dryer 22, the refrigerant passes through a metering means which is in the form of a capillary tube 23 that provides a pressure differential between the high pressure side of conduit 14 and the low pressure side which is provided by means of evaporator coil 24 which acts as an expansion chamber wherein the pressure of the refrigerant is reduced. The low pressure refrigerant then passes from coil 24 into the suction line cleanup filter/dryer 25 which may or may not have a removable core and then through suction tube 26 into the suction line 13 through suction line service valve 27.

The manifold 18 includes an intake cut-off valve 28 which adjusts the flow of refrigerant through intake port 17 into the manifold 18. The pressure of the incoming refrigerant, measured in pounds per square inch is indicated by intake gauge 29. A similar discharge cut-off valve 30 is provided on manifold 18 adjacent the discharge port 20. The discharge pressure gauge 31 meters the discharge flow rate of the outgoing refrigerant.

A refrigerant port 32 is located on manifold 18 between ports 17 and 20 and is in communication through refrigerant tube 33 with a supply of new refrigerant in container 34. The amount of new refrigerant entering the manifold 18 is controlled by on-off valve 35.

OPERATION

The device 10 can be of use to air conditioning/refrigeration service personnel, particularly on systems which do not have pump down capabilities. While the refrigerating apparatus 11 continues to operate, conduit 14 is connected to the apparatus 11 by means of liquid tube 15 being attached through valve 16 to liquid line 12 and by means of suction tube 26 being connected to suction line 13 through valve 27. Some of the high pressure refrigerant passes from liquid line 12 into liquid tube 15 and into manifold 18 through inlet port 17. The flow rate into the manifold 18 may be selectively adjusted by valve 28.

The refrigerant passes through outlet port 20 into discharge tube 19 where it passes through sight glass 21. The operator can visually detect by means of sight glass 21 the degree, if any, of contamination of the refrigerant by inspecting the refrigerant for particles and discoloration. The moisture indicator on the sight glass 21 will detect any moisture present in the refrigerant. From the sight glass 21, the refrigerant passes into the liquid line filter/dryer 22 wherein some of the moisture/acid and particles are removed.

The liquid refrigerant, still under pressure, then enters the capillary tube 23 which has a restricted diameter and then passes into the evaporator coil 24 wherein the refrigerant expands and loses pressure. The refrigerant absorbs heat for evaporation from the warm air discharge from the air cooled condensing unit of apparatus 11. In the case of heat pumps in the heating cycle, the heat of evaporation can be provided by oil, gas or electrical heat source.

The low pressure refrigerant, now in the gaseous phase, goes into the suction line cleanup filter/dryer 25 to remove more moisture/acids and other contaminants. From the filter/dryer 25, the refrigerant is discharged back into the apparatus 11 through suction tube 26, service valve 27 and into suction line 13.

If it is desired to inject fresh refrigerant into the apparatus 11, valve 28 or valve 16 can be closed to stop refrigerant from apparatus 11 from entering into the manifold 18. Valve 35 can be opened to allow the new refrigerant from container 34 to pass through refrigerant tube 33 into refrigerant port 32 whereby the new refrigerant enters manifold 18 and conduit 14. The refrigerant port 32 should be upstream from outlet port 20. When a sufficient supply of fresh refrigerant has entered the system, valve 35 is closed and valve 28 or valve 16 can be opened to allow the refrigerant discontamination process to continue. Port 32 can be capped if it is not desired to have new refrigerant enter the system.

The device 10 can be connected to apparatus 11 for a time sufficient to allow all of the refrigerant within apparatus 11 to pass through device 10. Normally, 24-48 hours will be enough time. The tubes 15, 26 are detached from respective service valves 16 and 27 in order to disconnect the device from the apparatus 11. The tubes 15, 33, 19 and 26 can be standard refrigeration hoses.

Various modifications of device 10 can be effected without changing its overall utility and function. Such modifications include the deletion of one of the dryers 22 or 25. Additionally, the manifold 18 can be elimated and substituted in its place a conventional three-way valve interconnecting tubes 14, 19 and 33.

For purposes of removing contaminants only, tube 19 may be connected to valve 16 eliminating manifold 18 completely, as capacity of metering device 23 can vary with cooling capacity of apparatus 11.

What I claim is:

1. A device for adding on to a refrigeration system having a liquid refrigerant line, a suction line, and connecting lines therefore, said device comprising:

a. a conduit means for communicating the refrigerant line to said suction line; means for connecting opposite ends of the conduit means respectfully to the suction line and the liquid refrigerant line;

b. means in said conduit means for removing contaminents from said refrigerant;

c. means for selectively connecting a source of new refrigerant with said conduit means; and d. means in said conduit means adjacent said suction line for creating a pressure differential for said refrigerant from a liquid to a vapor.

2. A device as claimed in claim 1 wherein means are provided for releasably securing said conduit means to said device.

3. A device as claimed in claim 1 wherein said device further includes means in said conduit means for visually detecting contaminants within said refrigerant.

4. A device as claimed in claim 1 wherein said contaminant removing means includes a filter/dryer adjacent said liquid line.

5. A device as claimed in claim 1 wherein said contaminant removing means includes a filter/dryer adjacent said suction line.

6. A device as claimed in claim 1 wherein said contaminant removing means includes a filter/dryer adjacent said liquid line and a filter/dryer adjacent said suction line.

7. A device as claimed in claim 1 wherein said connecting means includes a manifold in said conduit means, said manifold having a first inlet port for receiving said refrigerant from said liquid line, an outlet port through which said refrigerant is discharged to said suction line and a second inlet port located upstream from said outlet port and in fluid communication with said source of new refrigerant.

8. A device as claimed in claim 7 wherein said manifold further includes valve means to control the flow of said refrigerant through said first inlet port and wherein said source of new refrigerant includes a vlave means to control the flow of said new refrigerant from said source to said manifold.

* * * * *